US008528654B2

(12) United States Patent
Nease et al.

(10) Patent No.: US 8,528,654 B2
(45) Date of Patent: Sep. 10, 2013

(54) ANTI-PIRACY SYSTEM AND METHOD

(75) Inventors: Timothy D. Nease, Hickory, PA (US); Ralph H. Pundt, Brooksville, ME (US); Larry Wilkinson, Vicksburg, MS (US); Christy Pecanty, legal representative, Vicksburg, MS (US); John C. Lee, Camano Island, WA (US); Larry V. Wade, Bradley, ME (US)

(73) Assignee: International Maritime Security Network, LLC, Wellsburg, WV (US)

( * ) Notice: Subject to any disclaimer, the term of this patent is extended or adjusted under 35 U.S.C. 154(b) by 368 days.

(21) Appl. No.: 12/872,009

(22) Filed: Aug. 31, 2010

(65) Prior Publication Data

US 2011/0127358 A1 Jun. 2, 2011

Related U.S. Application Data

(60) Provisional application No. 61/240,731, filed on Sep. 9, 2009.

(51) Int. Cl.

| | |
|---|---|
| ***B05B 1/00*** | (2006.01) |
| ***A62C 3/00*** | (2006.01) |
| ***A62C 3/07*** | (2006.01) |
| ***A62C 3/08*** | (2006.01) |

(52) U.S. Cl.
USPC ..... 169/43; 169/54; 169/62; 169/5; 239/597

(58) Field of Classification Search
USPC ..... 239/597; 169/54, 62, 5, 14, 16, 169/18, 13, 43
See application file for complete search history.

(56) References Cited

U.S. PATENT DOCUMENTS

| | | | | |
|---|---|---|---|---|
| 2,576,143 | A * | 11/1951 | Rochet | 169/16 |
| 3,581,621 | A * | 6/1971 | Bauer | 89/36.14 |
| 4,058,256 | A * | 11/1977 | Hobson et al. | 239/101 |
| 4,097,000 | A | 6/1978 | Derr | |
| 4,372,395 | A * | 2/1983 | Hammett | 169/69 |
| 5,823,447 | A | 10/1998 | Maybach | |
| 6,360,973 | B1 | 3/2002 | Stilli | |
| 6,695,068 | B2 * | 2/2004 | Woodall et al. | 169/47 |
| 6,866,211 | B2 | 3/2005 | Paulsen et al. | |
| 7,163,163 | B2 | 1/2007 | Waddelow | |
| 7,708,211 | B2 | 5/2010 | Maier et al. | |

(Continued)

FOREIGN PATENT DOCUMENTS

WO WO 2004/075132 9/2004

*Primary Examiner* — Len Tran
*Assistant Examiner* — Justin Jonaitis
(74) *Attorney, Agent, or Firm* — McKay & Associates, P.C.

(57) ABSTRACT

An anti-piracy system for a vessel produces a non-lethal all of water along the side of the vessel to wash away a pirate. A cylindrical cap has a top, a bottom edge, a hollow interior, and an outside surface. A slit is defined within the outside surface forming a partial opening within the cap from the interior to the outside surface. A threaded hose fitting is formed within the interior, wherein the cap can be secured to a fire suppression node on the vessel with the downward face positioned over a side of the vessel for forcibly dispersing water through the slit downward over the side of the vessel. The cap is positioned near the deck of the vessel, just over the side of the vessel such that upon activation of the tire suppression system the water is directed downward over the side of the vessel.

5 Claims, 4 Drawing Sheets

(56) References Cited

U.S. PATENT DOCUMENTS

2007/0069049 A1 3/2007 Lipthal
2007/0114046 A1* 5/2007 Munroe ..... 169/16
2008/0116302 A1 5/2008 Sloan
2011/0103778 A1* 5/2011 Batts ..... 392/405

* cited by examiner

ANTI-PIRACY SYSTEM AND METHOD

CROSS-REFERENCE TO RELATED APPLICATIONS

The instant application claims benefit of provisional application Ser. No. 61/240,731 filed Sep. 9, 2009, the disclosure of which is incorporated herein by reference.

BACKGROUND

1. Field of the Invention

The instant invention relates to systems and methods for deterring pirate entry on to a ship. In particular, described is a system and method for producing a non-lethal wall of water in conjunction with the ships fire suppression systems adapted to travel down the side of the vessel, thereby prohibiting a trespasser from climbing up the side of the vessel.

2. Description of the Related Art

Pirate threats to vessels have been on the rise, resulting in an increase in the number of unauthorized entries onto cargo ships on the high seas. Mariners are relatively defenseless and at a minimum not trained to combat or deter attacks by pirates. Importantly, the International Maritime Organization (IMO) does not sanction the use of lethal force and it is up to the Flag State's authority to decide how best to protect their flagged vessels, resulting either in the express prohibition against carrying lethal weapons on board a cargo vessel or the lack of any direction on how to deal with the threat of piracy. Even if deadly force was authorized and available, use of firearms and weapons aboard a ship would increase the risk of injury or death to the crew.

Few non-lethal means for combating and repelling pirates are taught. For example, WO04075132A2 is a method and system for repelling and combating pirates which involves the use of spot lights. Specifically, one or more spot lights with intermittent pulsed voltage generation transmit flash light pulses or blocks of pulses towards the detected attacker.

Piracy on the high seas is continually on the rise and will remain a threat as long as vessels transport goods across the sea. A reliable defense system is required to stay one step ahead of the threat, and such defense system must be safe. The world Navies have limited resources and have not been able to effectively protect the world merchant fleets from piracy attacks. It has often been said that merchant crews need to find a way to fend for themselves.

What is needed then and as disclosed herein is a non-lethal system and method for deterring pirate entry aboard vessel which effectively fends off potential threats without active involvement from the crew. Accordingly, the instant system and method utilizes water from a vessel's fire suppression system, as follows.

SUMMARY

A specifically configured nozzle cap attaches to fire suppression nodes on the ship. The cap includes a hose fitting and slit defined within the cap on the underside thereof. The device creates an active deterrent by sending a consistent wall of water downward along the perimeter of the vessel. The device screws onto a network of pipe that uses the fire suppression system on a ship, maximizing the protective potential without risking the lives and safety of the ship's crew. It has no moving parts and can be removed to facilitate full use of the ship's fire suppression system.

It is the objective then to provide an anti-piracy system which serves as a physical obstacle for pirates attempting to scale a ship's hull.

It is further an objective provide a system which is non-lethal.

It is further an objective to provide a system which acts as a visual deterrent.

It is further an objective to provide a system which is low-profile and does not hinder the everyday duties of the crew.

It is further an objective to provide a system which utilizes existing fire suppression systems of the vessel, while not impacting the ordinary use of those systems.

It is further an objective to provide a system which can be assembled and disassembled efficiently.

Accordingly, what is provided is an anti-piracy system for a vessel, comprising a cylindrical cap having a top, a bottom edge, a hollow interior, and an outside surface formed of a semi-cylindrical downward face and a semi-cylindrical upward face. A slit is defined solely within the downward face with the upward face remaining integral throughout forming a partial opening within the cap from the interior to the outside surface. A threaded hose fitting is formed within the interior, wherein the cap can be secured to a fire suppression node on the vessel with the downward face positioned over a side of the vessel for forcibly dispersing water through the slit downward over the side of the vessel. Thus, the method for deterring pirate entry onto a vessel includes attaching the cap to a fire suppression node of the vessel, wherein the node is an outlet for water exiting a fire suppression system of the vessel. The cap is configured to act as a spray nozzle for the water. The cap is positioned near the deck of the vessel, just over the side of the vessel such that upon activation of the fire suppression system the water is directed downward over the side of the vessel, as a result producing a nova lethal wall of water along the side of the vessel to wash away the pirate and flood a pirate's vessel.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications and applications as would normally occur to persons skilled in the art to which the invention relates. This detailed description of this invention is not meant to limit the invention, but is meant to provide a detailed disclosure of the best mode of practicing the invention.

Figure 1:
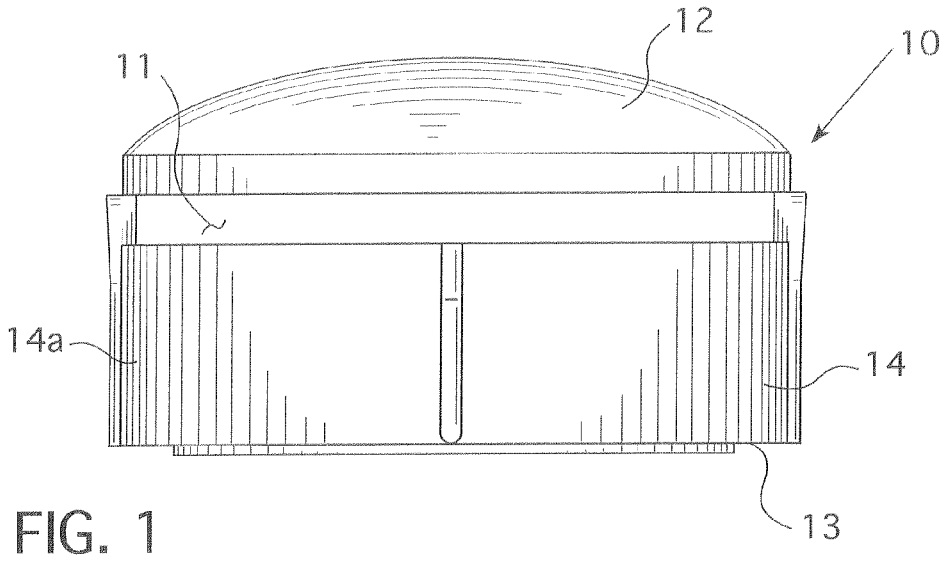
FIG. 1, shows a front elevation view of the nozzle cap of the instant invention
Figure 2:
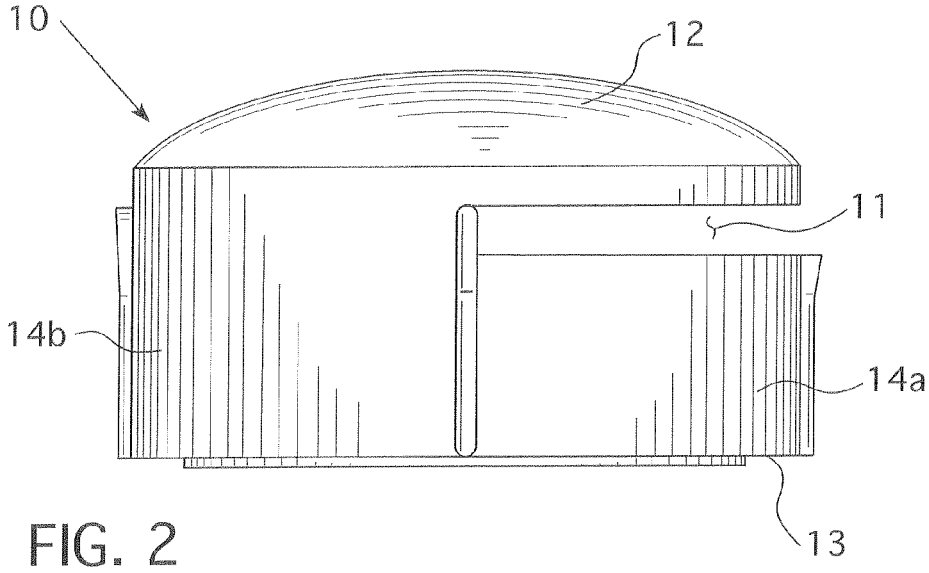
FIG. 2 shows a side elevation view of the cap.
Figure 3:
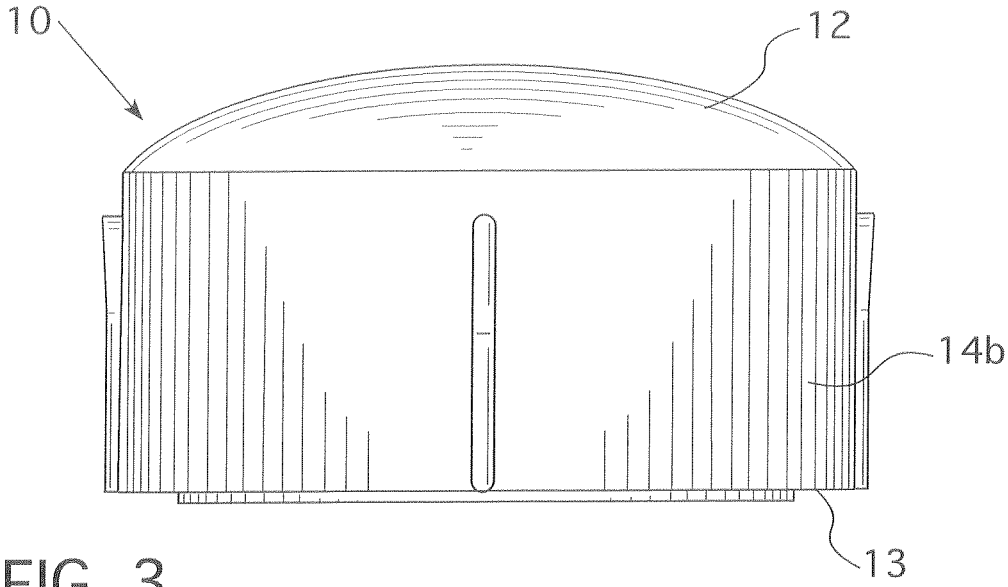
FIG. 3 shows a rear view of the cap.
Figure 4:
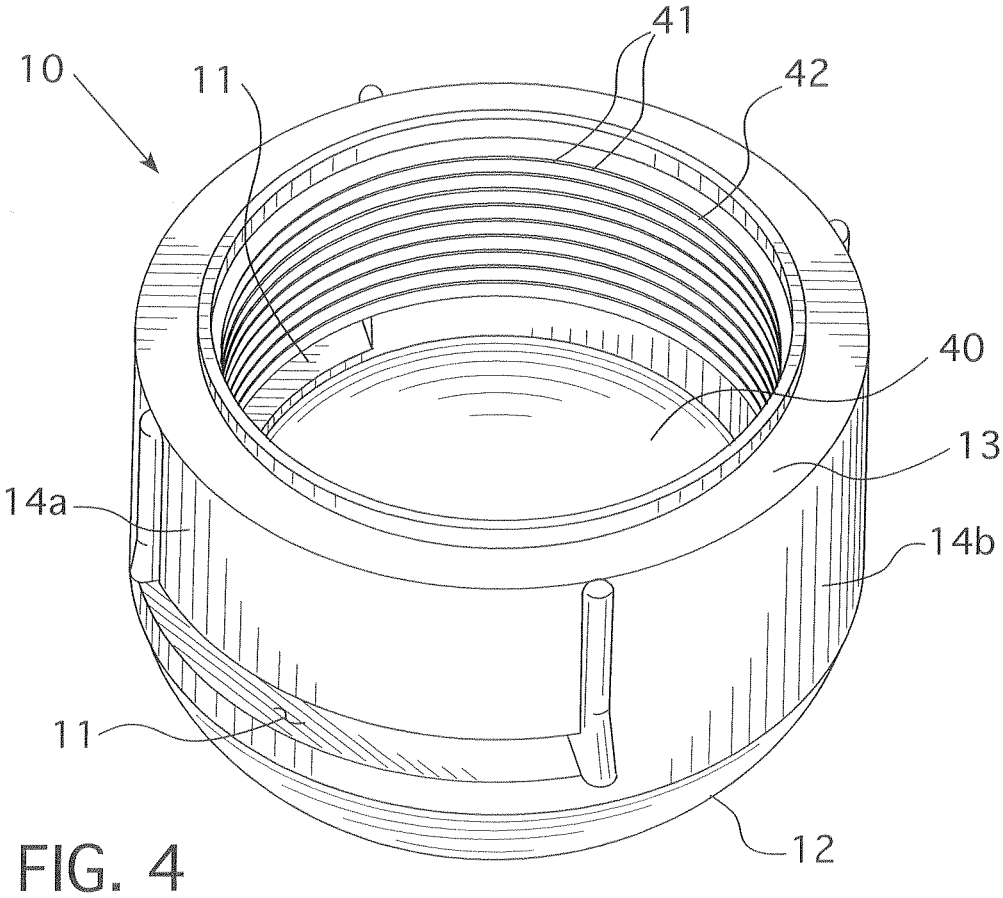
FIG. 4 shows an inside perspective view of the cap revealing the threaded fitting.
Figure 5:
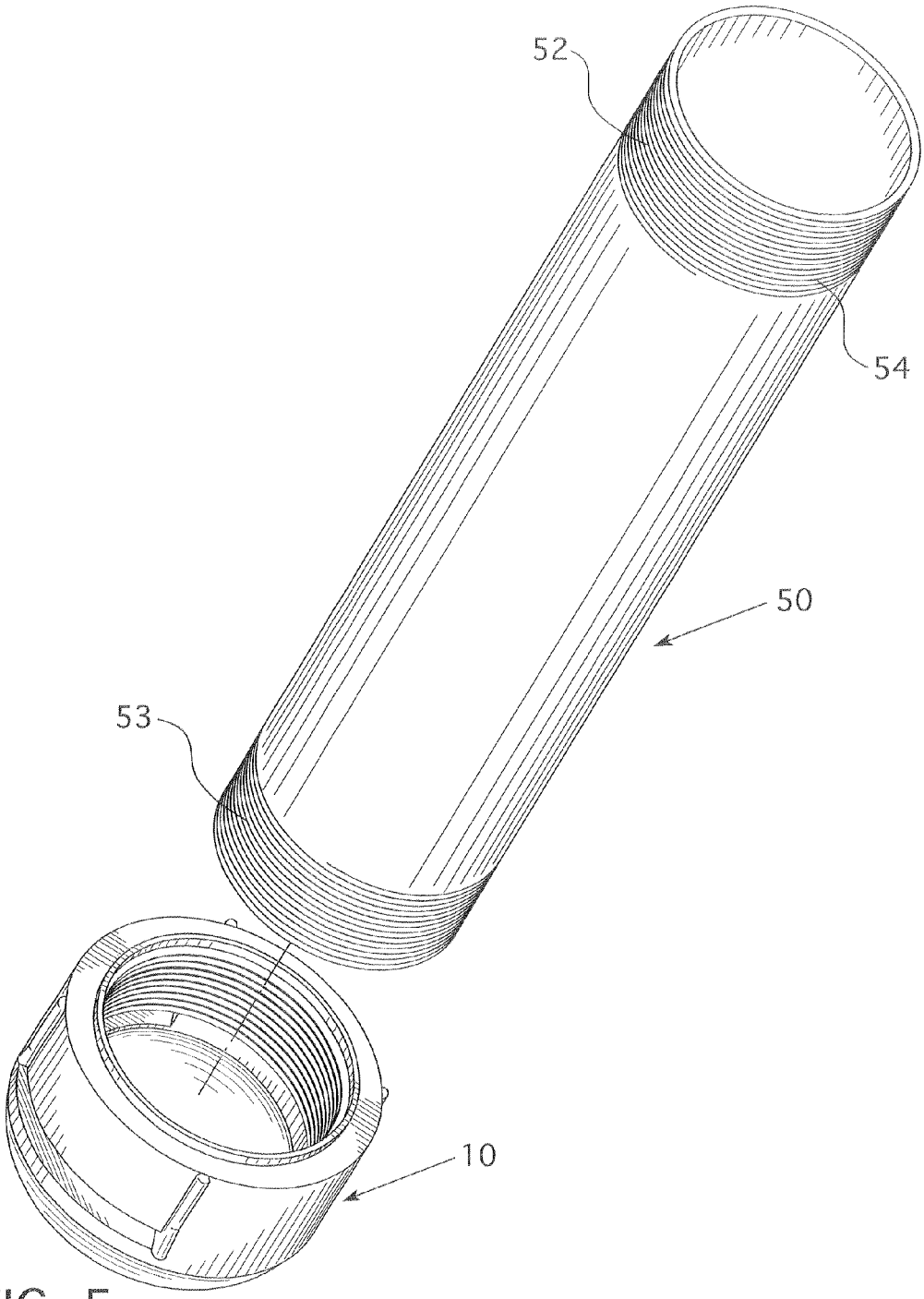
FIG. 5 shows a side elevation view of the tube which acts as an extension from the cap to the fire suppression node.
Figure 6:
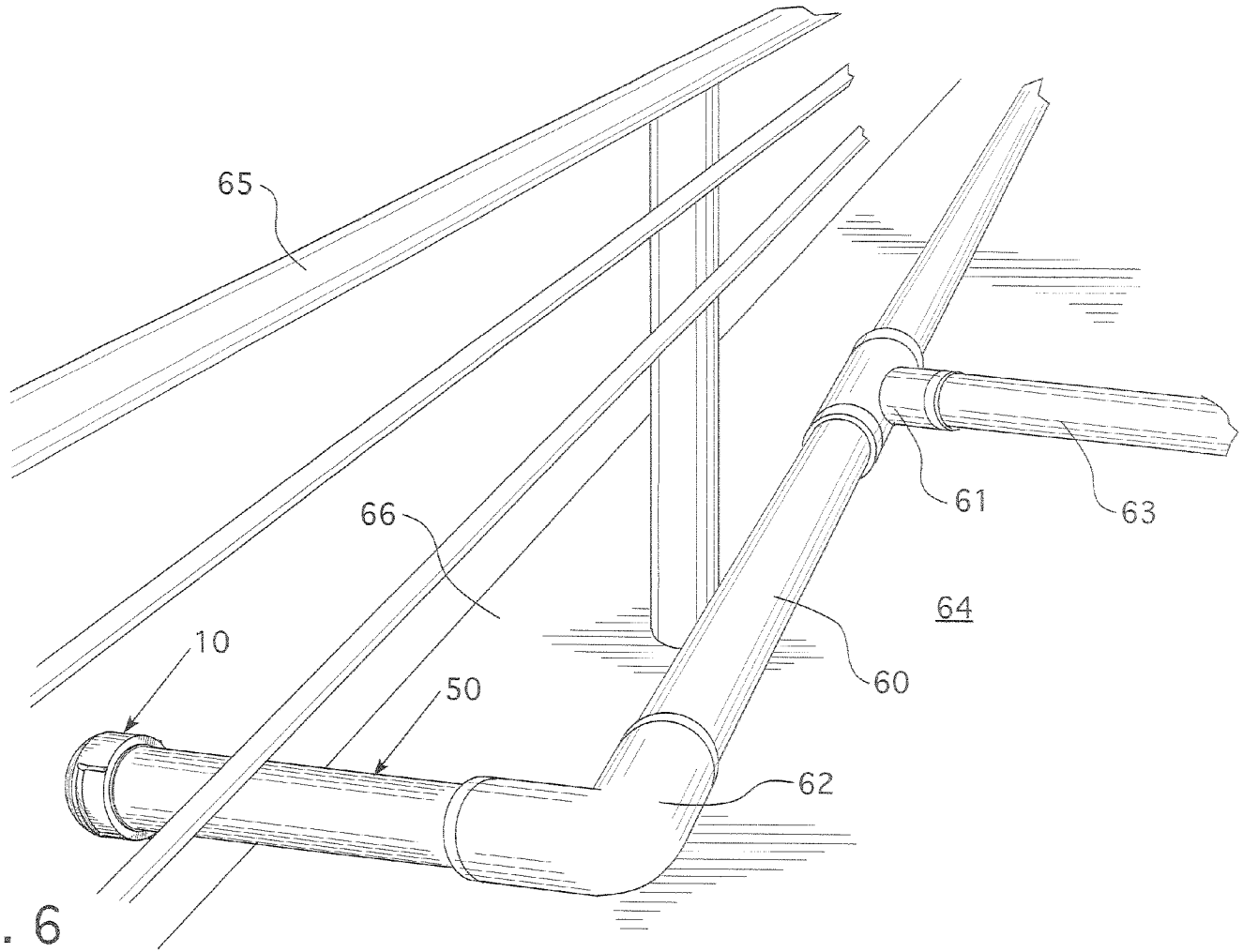
FIG. 6 shows a perspective view of one embodiment of the instant invention in use wherein the fire suppression "node" includes a network of piping disposed along the deck of the vessel for connecting the cap and extension to the fires suppression system of the vessel.

With reference then to FIGS. 1-6, the system comprises three main components, namely the cap 10, the tube 50 (FIG. 5), and the fire suppression node 60, or one embodiment of which is the tire suppression node 60 being a network of piping as shown by FIG. 6. In general, the cap 10 will always be used, the tube 50 is optional depending on what type of tire suppression node 60 is implemented, and "node" as used herein refers to the means by which the cap (with or without the tube) is connected to the outlet of a ship or vessel's fire suppression system, thus tire suppression node 60. For instance the fire suppression node 60 can be the end of a fire hose connected to the tire suppression system pump; a single fire main extension 63 (FIG. 6) having one end connected to the tire suppression system; any network of piping; or a direct connection to the tire suppression system itself. The system hooks into the fire suppression system and uses the vessel's existing pumps to create a wall of water, as follows.

Cap 10 is a cylindrical nozzle cap, preferably made of schedule 80 or schedule steel pipe, bronze or other hard metal or metal alloy. In on embodiment the cap 10 has a diameter of approximately 2.5 inches. Size of cap 10 can vary but this size diameter has shown to be very conducive to the instant application when matched with the other dimensions below. Cap 10 has a top 12, a bottom edge 13 opposing the top 12, a hollow interior 40, and an outside surface 14 formed of a semi-cylindrical downward face 14*a* and a semi-cylindrical upward face 14*b*. Downward face 14*a* and upward face 14*b* are two separate surfaces for identification purposes but are integrally joined halves which form the cylindrical outside surface 14 of cap 10. Downward face 14*a* refers to the surface of the cap 10 which would face downward when the cap 10 is in use, and upward face 14*b* refers to the surface of the cap 10 which oppositely would face upward when the cap 10 is in place.

A slit 11 is defined within the outside surface 14, preferably solely within downward face 14*a*, with the upward face 14*b* remaining integral throughout, thereby forming a partial opening within the cap 10 from the interior to the outside surface 14. Slit 11 is defined towards the top 12 with a width in the range of 3/16 to 5/8 inches. In the preferred embodiment width of slit is ¼ inches. Slit 11 is defined close to top 12 to allow the cap 10 to be as secured as possible but still have structural integrity. Slit 1 optimally travels a distance of slightly less than half the circumference of the cap, e.g. the slit 11 travels slightly less than (just under) 180° around the cap 10 within the downward face 14*a* to define the opening as having a length of slightly less than the diameter of the cap 10. "Slightly less" as used herein therefore is defined as less than 180° or less than the diameter of the cap, but as little as a fraction less than this so as to simultaneously allow a wide, fan-like dispersion of water while maintaining all water in a downward direction (not sideways or upward). The above dimensions are critical in that the slit 11 is meant to forcibly disperse large amounts of water downward over the side of the vessel. Slit 11 which is too long will cause water to be dispersed sideways or even upwards through cap 10, and a slit 11 which is too short or too narrow will cause excess pressure and thus potential damage, back-flow and/or choked flow. A slit 11 which is too wide will decrease the water pressure and then lessen the force/impact of the downwardly directed water. The above dimensional ranges have been determined to be optimum based on many experiments and testing, in conjunction with the 2.5 inch cap.

A fitting 42 is formed within the interior 40 of cap 10 (see FIG. 4). In this manner the cap 10 can be secured to the fire suppression node 60 on the vessel with the downward face 14*a* positioned over a side of the vessel for forcibly dispersing water through the slit 11 downward over the side of the vessel. As can be seen, fitting 42 in this embodiment is made of a plurality of threads 41 disposed about the inside circumference of the cap interior 40 such that cap 10 is screwed onto fire suppression node 61. Threads 41 are situated an area of the interior 40 defined by the slit and the bottom edge of the cap 13 such that the opening remains exposed when the cap 10 is secured to the fire suppression node 60. Cap 10 may also be secured to fire suppression node 60 other than by threads 41, such as, including but not limited to clips, adhesives, clamps, rivets, snaps, or other means although since fire hoses and similar "nodes" include threaded ends the instant cap 10 and thread 41 design is most suitable. Such will depend on the receiving end of the node and the instant embodiment is intended to encompass these means for securing the cap 10.

FIG. 5 shows an embodiment of an optional tube 5, which forms part of the system. Tube 5 preferably has ends, namely a first end 51 and a second end 52, each end 51, 52 respectively including first end threads 53 and second end threads 54. The tube 50 is configured to act as an extension between cap 10 and fire suppression node 60 to enable cap 50 to extend out over the side of the vessel should cap 10 not easily fasten to fire suppression node 60. Typically, tube 50 would be used if fire suppression node 60 is in the form of a network of piping.

FIG. 6 therefore shows the embodiment of the fire suppression node 60 taking the form of a network of pipe. As shown fire suppression node 60 is arranged about the deck 64 of the vessel 66, proximate to rail 65. Such a configuration provides a low profile and thus safely maintains the system out of the way of the crew and cargo. The network of pipe can contour around obstacles and provides little obstruction, running mainly along outer rails 65. The piping network may also be configured internally within the ship rather than on the deck depending on the location of the ship's fire suppression system or ballast pump system. In this embodiment, cap 10 connects to tube 50. Tube 50 then connects to a rounded joint 62. Secondary tube 67 then connects to a manifold 61, which in turn allows for the connection to fire main extension 63. Fire main extension 63 would therefore connect to the fire suppression system of the vessel 66.

A gated 'Y' adapter preferably is utilized at the outlet of the fire suppression system into which the fire main extension 63 is fitted. The adapter allows the crew to fight a fire and run the system at the same time. Even without the adapter however, because the system has no moving parts, the nozzle caps 10 and/or the piping network components can be removed to facilitate full use of the vessel's fire suppression system if needed.

Product testing has shown with the caps 10 configured with the dimensions as shown, the network of piping is preferably broken down into sections in which there is one cap 10 and thus one downward facing nozzle situated approximately every twenty (20) feet. A twenty-foot spread results in the spray from each nozzle to overlap. Results using this configuration are described in Example 1 below:

EXAMPLE 1

Utilizing a two-man team a complete system was placed, assembled, and tied into the ship's fire system in between two and six hours per manifold. The time was reduced greatly with crew assistance. With two pumps running at 500 Gallons Per Minute (GPM) and one at 750 GPM, the system generated a consistent 280 GPM from each manifold. Each manifold could potentially generate 1000 GPM on large, more modern ships utilizing stronger pumps. During phase 11 tests the system generated approximately 75 PSI of pressure from each nozzle cap. 100 PSI is ideal, the system functioning best with a high volume of water and moderate water pressure. The system operated both at sea while underway and while anchored.

One way to form the product and correctly position the nozzle cap 10 and thus slit 11 such that it is positioned entirely downward over the side of vessel in order to maintain all water flow downward as well, is to use a reference mark (not shown) etched or drawn anywhere on the outer surface of cap 10. Cap 19 is screwed onto node. Reference mark is drawn. An indicator line such as an inked line, etch, or other marking is then drawn or scratched to indicate the appropriate position of slit 11, opposite the reference mark. Cap is then unscrewed and the slit 11 is then cut into the nozzle cap 10 along the indicator line. Such markings can also be pre-fabricated. Once defined, the slit 11 positioned appropriately each time it is wound onto the node with the reference mark started in the same position.

In use with the nozzle caps 10 in place, when activated the system creates an active deterrent by sending a consistent all of water downward along the perimeter of the vessel. The "wall of water" or deluge effect of the nozzle caps 10 makes boarding much more difficult because essentially someone has to climb through a waterfall. One has to look up into the water curtain to climb up to the main deck, which makes it a near drowning situation and makes it very difficult for the boarder to breath. Directing a wall of water down the side of the ship in the direction of the entrant results in the washing away of the entrant and the potential flooding of the entrant's vessel. Vision is another factor which is reduced as the threat climbs aboard.

The instant system also works with the vessel's ballast pump system if equipped. Utilization of the ballast pump system can be in conjunction with or alternative to the use of the ship's fire suppression system and would require modification of the location and arrangement of the network of piping. On these types of ship ballast systems the water can be heated to about 180 degrees if necessary or desirable. When required, irritants or slippery substances can also be added, such as pepper oil or soap, hereinafter "secondary components". The secondary components can be injected locally or from a remote location. All the above can be accomplished without risking the crew because once the system is installed externally or internally and operating the crew can keep the system running while underway, at anchor, or even to protect the offshore side of the vessel while handling cargo. Thus the system provides the first line of defense as the crew is mustered within a safe house or elsewhere on the ship.

We claim:

1. A method for deterring pirate entry onto a vessel, comprising the steps of:

attaching one or more caps to a fire suppression node of said vessel, wherein each said cap includes a slit defined solely within a downward face of said cap, and wherein said node is an outlet for water exiting an existing fire suppression system of said vessel, said cap configured to act as a spray nozzle for said water;

positioning said caps near a deck of said vessel just over a side of said vessel such that upon activation of said fire suppression system said water is directed entirely downward through said slit over the side of the vessel and maintained downward, as a result producing a non-lethal wall of water along the side of the vessel to wash away said pirate and flood a pirate's vessel.

2. The method of claim 1, wherein for the step of positioning said caps, each said cap is spaced twenty feet apart.

3. The method of claim 1, further comprising the step of adding a secondary component to said water.

4. The method of claim 1, wherein said outlet is for water exiting a ballast pump system of said vessel.

5. The method of claim 4, further comprising the step of heating said water to a temperature of up to 180° Fahrenheit.

* * * * *

UNITED STATES PATENT AND TRADEMARK OFFICE

CERTIFICATE OF CORRECTION

PATENT NO. : 8,528,654 B2
APPLICATION NO. : 12/872009
DATED : September 10, 2013
INVENTOR(S) : Nease et al.

It is certified that error appears in the above-identified patent and that said Letters Patent is hereby corrected as shown below:

Title Page

Item (57) Abstract, line 1:

"all" should read -- wall --;

Item (57) Abstract, line 12:

"tire" should read -- fire --;

In the Specification

Col. 2, line 37:

"nova lethal" should read -- non-lethal --;

Col. 3, line 7:

"tire" should read -- fire --;

Col. 3, line 13:

"tire" should read -- fire --.

Signed and Sealed this
Fifteenth Day of October, 2013

Teresa Stanek Rea

Teresa Stanek Rea
*Deputy Director of the United States Patent and Trademark Office*